US007810814B1

(12) United States Patent
Chapman et al.

(10) Patent No.: US 7,810,814 B1
(45) Date of Patent: Oct. 12, 2010

(54) STRATEGIC PATTERN BUILDING BOARD GAME WITH EJECTING FEATURE

(75) Inventors: Katharine Chapman, Ascot (GB); Lee Lenkarski, Belchertown, MA (US)

(73) Assignee: Hasbro, Inc., Pawtucket, RI (US)

( * ) Notice: Subject to any disclaimer, the term of this patent is extended or adjusted under 35 U.S.C. 154(b) by 24 days.

(21) Appl. No.: 12/323,758

(22) Filed: Nov. 26, 2008

(51) Int. Cl.
*A63F 3/00* (2006.01)

(52) U.S. Cl. ..... 273/271; 273/236; 273/287

(58) Field of Classification Search ..... 273/236, 273/241, 265, 271, 275, 281, 282.1, 282.3, 273/287; D21/334, 336, 341, 342; 40/449, 40/110, 488

See application file for complete search history.

(56) References Cited

U.S. PATENT DOCUMENTS

| | | | | |
|---|---|---|---|---|
| 3,149,842 | A | 9/1964 | Cirrincione | |
| 3,506,267 | A | 4/1970 | Taillie | |
| 4,067,576 | A * | 1/1978 | Balas et al. | 273/282.1 |
| 4,243,227 | A * | 1/1981 | Strongin | 273/357 |
| 4,381,112 | A | 4/1983 | Dupuy | |
| 5,154,428 | A | 10/1992 | Woolhouse | |
| 6,428,003 | B1 * | 8/2002 | Fondin et al. | 273/241 |
| 6,513,708 | B2 * | 2/2003 | Evans | 235/64 |
| 6,533,277 | B1 | 3/2003 | Yin | |
| D535,703 | S | 1/2007 | Creech | |
| D544,548 | S | 6/2007 | Miller | |

* cited by examiner

*Primary Examiner*—Vishu K. Mendiratta
(74) *Attorney, Agent, or Firm*—Perry Hoffman

(57) ABSTRACT

A game apparatus for a strategic pattern building board game with a feature for ejecting playing markers is defined. The game board has a multiplicity of channels having a first end and an opposite second end for receiving and ejecting playing markers respectively. The multiplicity of channels may be disposed between a first wall having a multiplicity of first apertures that define a matrix within the first wall and a second wall having a multiplicity of second apertures juxtaposed relative to the first wall. One or more openings disposed at the second end allow a player to eject playing markers. A retainer may be used to maintain playing markers in the matrix, and the retainer may comprise a pivoting and shifting set of bars that allows or prevents ejecting and emptying the matrix of playing markers. Some playing markers have indicia that define game play.

12 Claims, 10 Drawing Sheets

STRATEGIC PATTERN BUILDING BOARD GAME WITH EJECTING FEATURE

FIELD OF THE INVENTION

The present invention relates to a game assembly, and more particularly to a board game that involves strategic pattern building with a feature for ejecting game pieces during game play.

BACKGROUND OF THE INVENTION

For centuries board games have been an extremely popular form of entertainment for people of all ages. These types of games have been designed both for a single player and for competition between two or more players. Many games, such as Yahtzee™, mainly involve chance. Many games, such as backgammon, involve a combination of chance and skill, and many games, such as chess, mainly involve skill.

The present invention relates to games of skill that involve a competition between two players to build a desired pattern on the game board while preventing the opposing players from building the desired pattern. Popular games of this genre include Pente, gomoku, renju, and Milton Bradley's™ Score Four™.

Since 1974, the genre of pattern building games has included the very popular game of Connect Four™, a game also published by Milton Bradley™. A much older version of Connect Four™ is known as "The Captain's Mistress".

Connect Four™ is a two player game in which the players take turns dropping alternating colored discs into a seven column, six row vertically suspended matrix. The object of the game is to connect four singly-colored discs in a row, vertically, horizontally, or diagonally, before one's opponent can do likewise. Connect Four™ was created for players age seven and older and has an expected playing time of ten minutes. However, Connect Four™ is limited because only one type of game may be played. Game play starts with an empty matrix, and players alternatively drop a colored disc into the matrix until the desired pattern is realized. Also, only one type of colored disc is used. Consequently, the difficulty and the enjoyment of the game are limited.

A strategic pattern building board game having a vertically suspended matrix that allows games pieces to be both inserted into the matrix and ejected from the matrix during game play is unknown in the prior art. This type of variation will allow a greater variety of games to be played, such as games starting with an empty matrix and games starting with the matrix full of game pieces. Additionally, using game pieces having indicia on the face of the pieces that affect game play is also unknown in the prior art. For example, dropping one of these game pieces into the matrix may allow a player to eject one or more game pieces from the matrix or may allow a player to take another turn.

Accordingly, it would be desirable to create a game that presents a variation in the aforementioned variables because the difficulty and the level of enjoyment of such a game would increase. The invention discussed in connection with the described embodiment addresses these and other deficiencies of the prior art.

The features and advantages of the present invention will be explained in or apparent from the following description of the preferred embodiment considered together with the accompanying drawings.

SUMMARY OF THE INVENTION

The present invention addresses the deficiencies of the prior art of strategic pattern building board games by expanding the limitations of a number of factors that are characteristic of that prior art. Particularly, game pieces may not only be inserted into a multiplicity of channels to build a desired pattern, but game pieces may also be ejected from the multiplicity of channels during game play. Furthermore, in addition to standard game pieces, which are only to build patterns by inserting or ejecting them from the channels, new types of game pieces are used to affect game play. These new types of game pieces have indicia that prompt further action when a particular piece is used, such as ejecting one or more game pieces from the channels or allowing a player to take an extra turn. Consequently, the difficulty and the level of enjoyment of the prior art is increased.

A described embodiment of the invention provides a game board assembly as a multiplicity of channels having a first end and a second end opposite the first end. A set of game pieces (playing markers) is loosely receivable by the channels at the first end. The second end has one or more openings for ejecting the playing markers from the channels. A retainer is used along the one or more openings for maintaining the playing markers.

More particularly, the described embodiment of the strategic pattern building board game has a first wall having a multiplicity of first apertures wherein the first apertures are within the wall and define a matrix. The game also has a second wall having a multiplicity of second apertures juxtaposed relative to the first wall. The channels are disposed between the first and second walls. The channels and the retainer are coupled with the first wall and the second wall to maintain the playing markers in the matrix.

Generally, in the described embodiment, the matrix is vertically suspended with respect to a horizontal supporting surface, supported by a stand. Thus, the retainer is designed to maintain playing markers in the matrix, to allow the playing markers to be ejected from the matrix, and to allow the matrix to be completely emptied. Consequently, the retainer in the embodiment comprises a first bar and a second bar, both pivotably mounted to the first and second walls. The second bar shifts between a first position and a second position wherein said first position allows playing markers to be ejected and said second position prevents playing markers from being ejected.

The playing markers in the described embodiment are such that a multiplicity of the playing markers defines a distinguishably identifiable subset of playing markers, for example having a distinguishable color. The playing markers further comprise a subset of playing markers comprising indicia wherein the indicia define game play. For example, depending on the indicia on the face of the second type of playing marker, the player may be able to remove one or more playing markers from the matrix or be able to take another turn.

The described embodiment also has a bracket slideably mounted to said first wall and said second wall to facilitate both game play and transporting the game and playing markers.

The described embodiment further has a counter for keeping score.

Finally, the described embodiment further comprises an attachment wherein the attachment attaches to the matrix in a first position as the aforementioned stand and a compartment for catching playing markers and in a second position as a carrying handle to facilitate transporting the game.

BRIEF DESCRIPTION OF THE DRAWINGS

The invention will now be more particularly described by way of example with reference to the accompanying drawings. Novel features believed characteristic of the invention are set forth in the claims. The invention itself, as well as the preferred mode of use, further objectives, and advantages thereof, are best understood by reference to the following detailed description of the embodiment in conjunction with the accompanying drawings, in which:

DETAILED DESCRIPTION OF THE EMBODIMENTS

Figure 1:
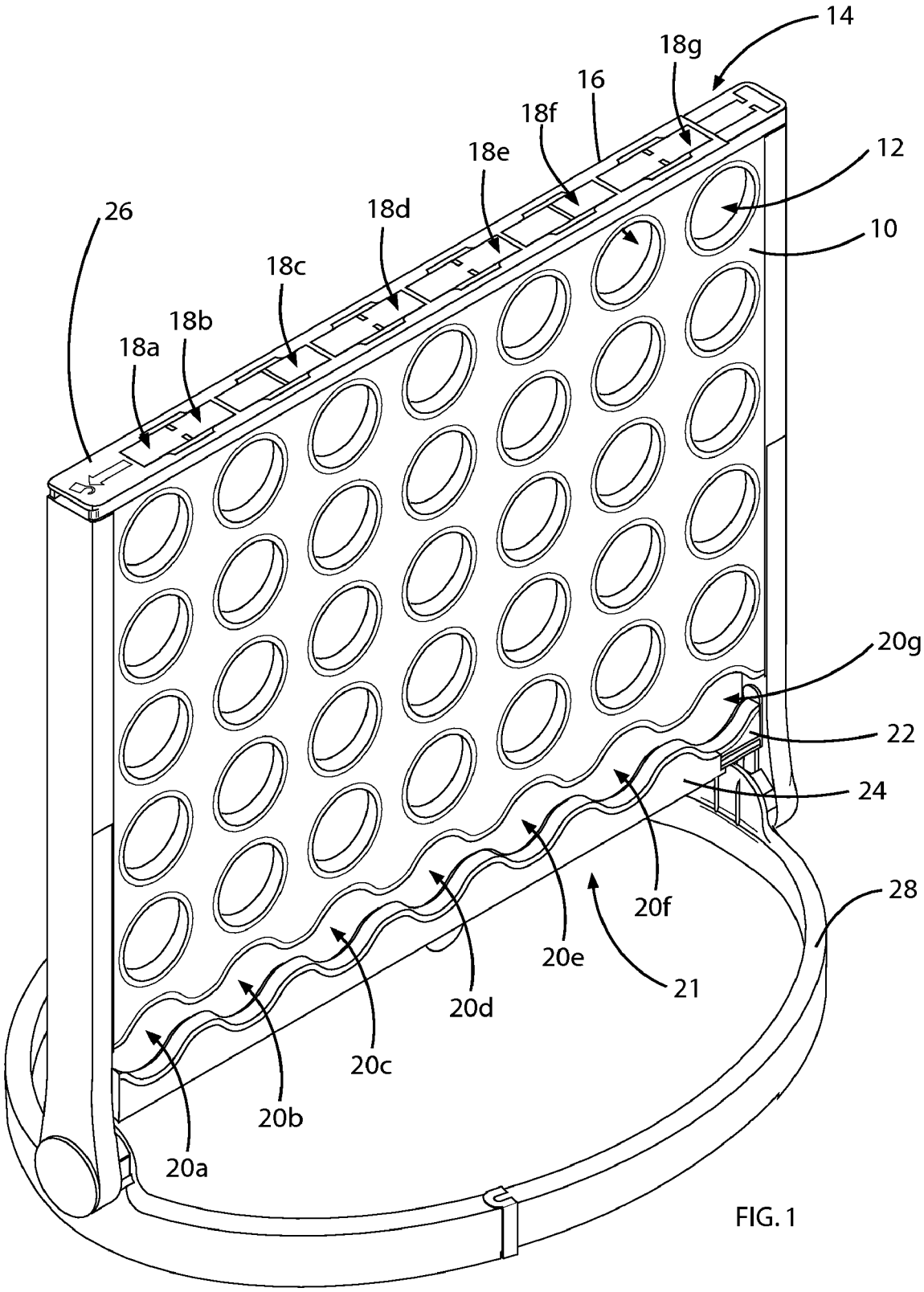
FIG. 1 shows a perspective view of the game assembly.

FIG. 1 shows a perspective view of the preferred embodiment of the strategic pattern building board game assembly. FIG. 1 shows the board game comprising a first wall 10 having a multiplicity of first apertures 12 and a second wall 14 having a multiplicity of second apertures 16 juxtaposed relative to said first wall 10. The first apertures 12 are within the first wall 10 to define a matrix of said first apertures 12 within the first wall 10. This figure shows a multiplicity of channels 18*a-g*, having a first end and a second end, disposed between said first wall 10 and said second wall 14. One or more openings 20*a-g* are disposed along the second end of said multiplicity of channels 18*a-g*. The first end along said multiplicity of channels 18*a-g* are for receiving playing markers, and the one or more openings 20*a-g* are for ejecting playing markers.

FIG. 1 shows said first wall 10 and said second wall 14 forming a vertically suspended matrix with respect to a horizontal supporting surface.

Figure 2A:
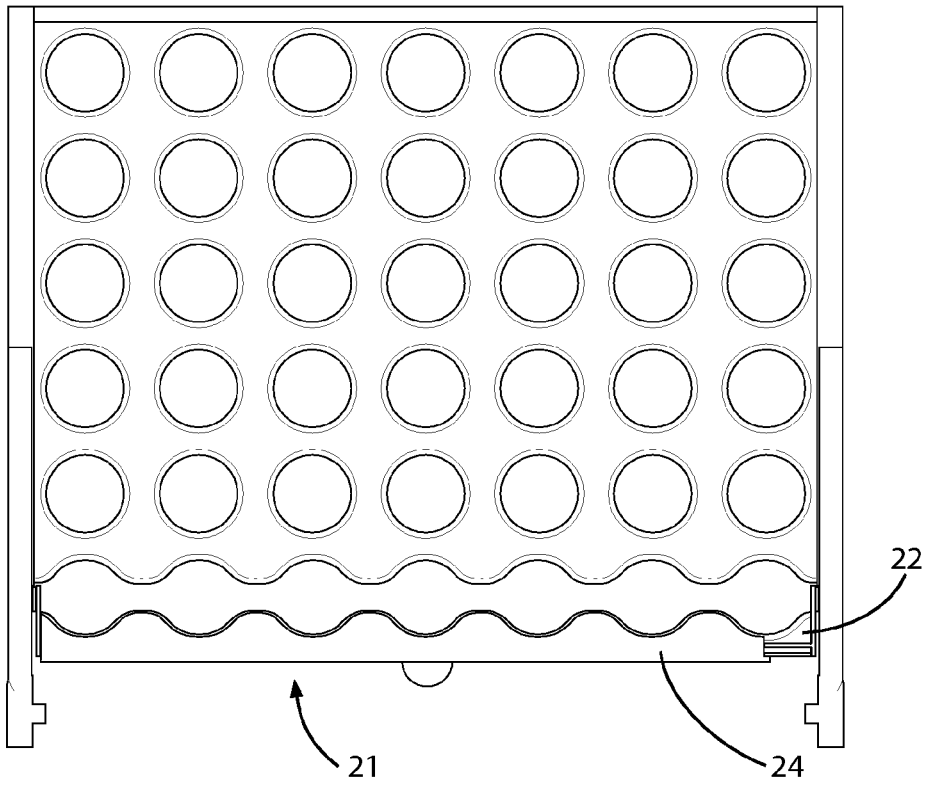
FIG. 2A shows a perspective view of the game assembly with the bars shifted so that playing markers may be ejected.
Figure 2B:
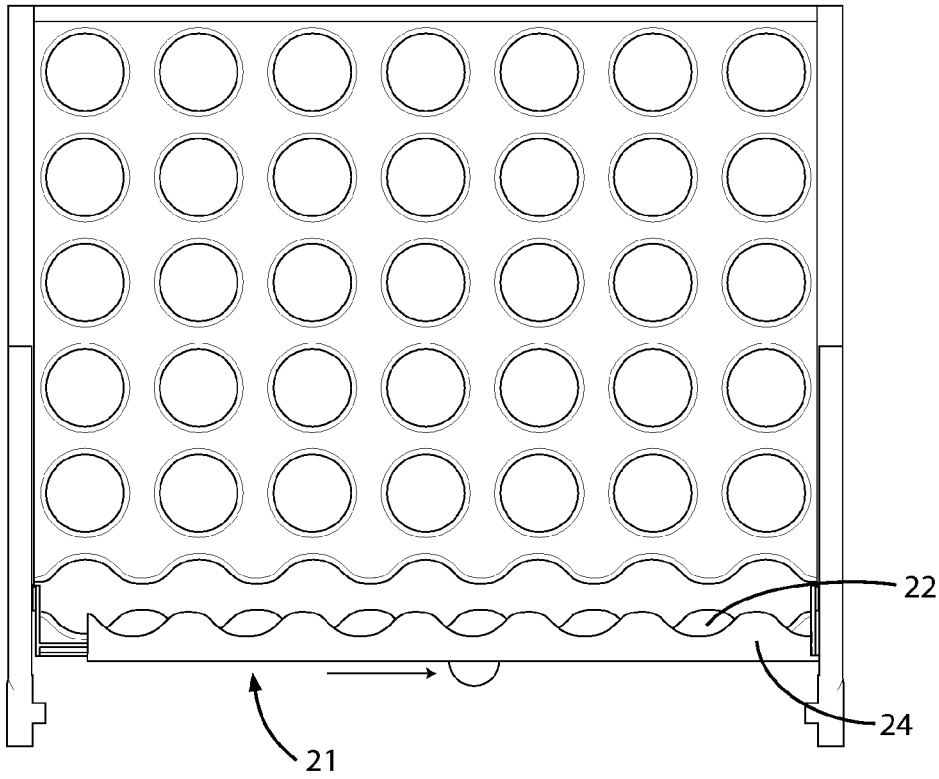
FIG. 2B shows a perspective view of the game assembly with the bars shifted so that playing markers may not be ejected.

FIG. 1 further shows the multiplicity of channels 18*a-g* and a retainer coupled with the first wall 10 and the second wall 14 for maintaining playing markers in the matrix. The retainer is shown as a first bar 22 disposed along said one or more openings 20*a-g* and a second bar 24 disposed along said one or more openings 20*a-g* that shifts between a first position and a second position wherein said first position allows playing markers to be ejected and said second position prevents playing markers from being ejected. FIG. 2A shows a perspective view of the game assembly with the bars shifted so that playing markers may be ejected, and FIG. 2B shows a perspective view of the game assembly with the bars shifted so that playing markers may not be ejected.

Figure 3:
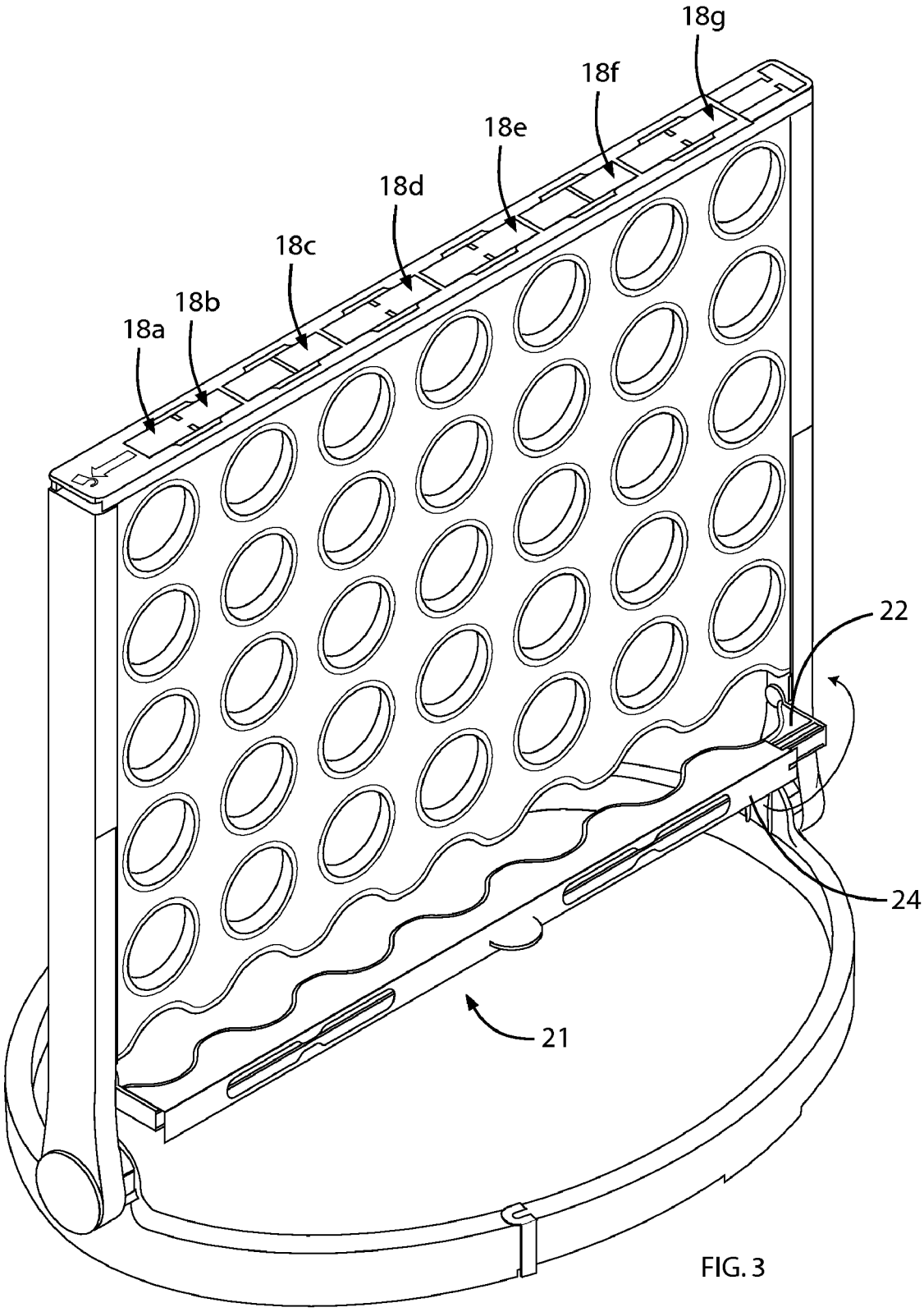
FIG. 3 shows a perspective view of the game assembly with the bars pivoted so that the matrix may be emptied of playing markers.

The first bar 22 and the second bar 24 are pivotably mounted to said first wall 10 and said second wall 14. FIG. 1, FIG. 2A, and FIG. 2B show the first bar 22 and the second bar 24 in a position where the game assembly maintains playing markers and prevents them from falling completely through the multiplicity of channels 18*a-g*. FIG. 3 shows a perspective view of the game assembly with the bars pivoted so that the matrix may be emptied of playing markers.

Figure 4:
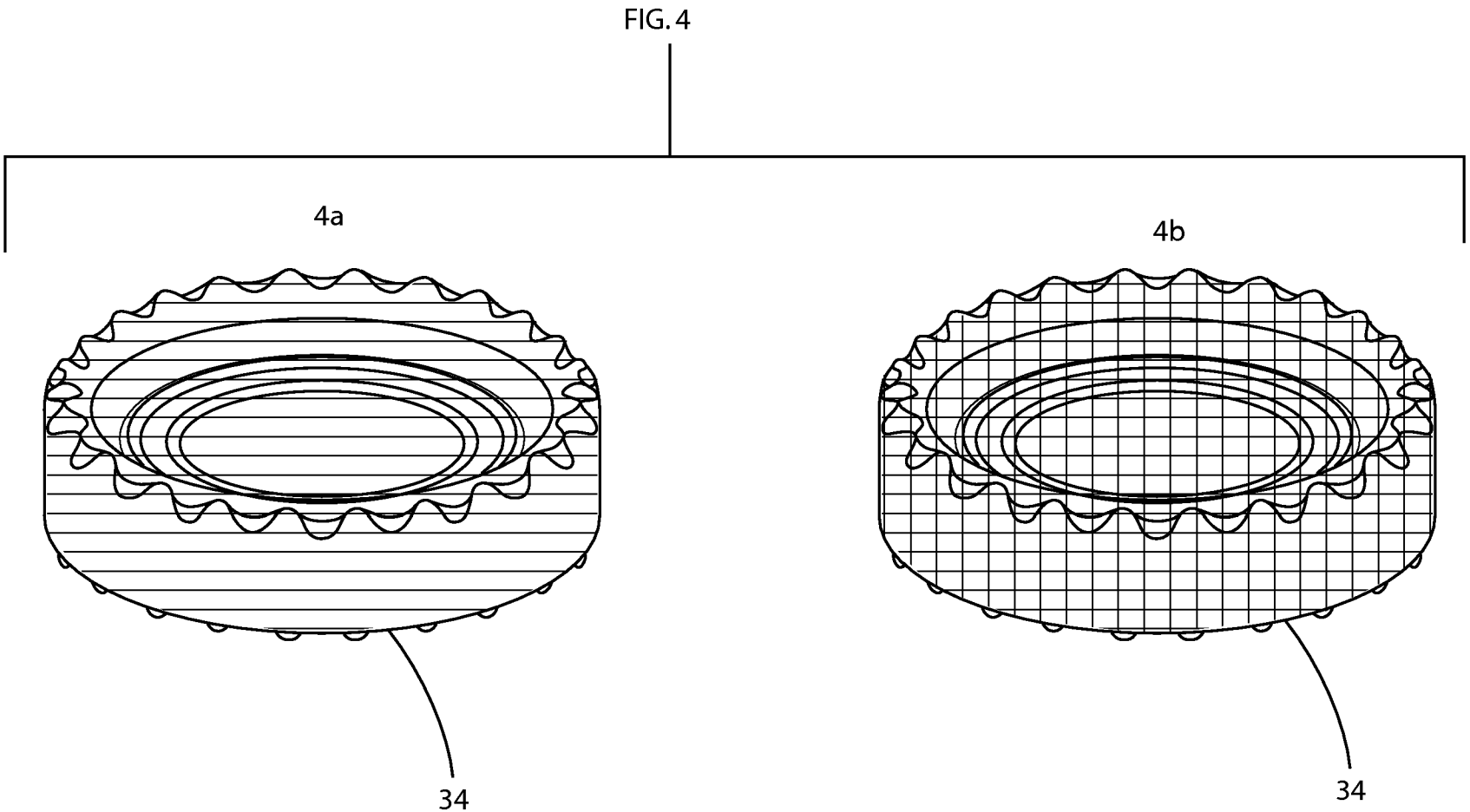
FIG. 4 shows two distinguishably identifiable playing markers without indicia.

FIG. 4 shows two distinguishably identifiable playing markers 34 without indicia that are loosely receivable by said multiplicity of channels 18*a-g* and ejectable from said one or more openings 20*a-g*. In the preferred embodiment, the game comprises a multiplicity of said playing markers 34 defining a distinguishably identifiable subset of said playing markers 34. FIG. 4 shows samples from two possible subsets as 4*a* and 4*b*. As shown in FIG. 4, a playing marker 34 is a round disc that has dimensions allowing it to be loosely receivable by the multiplicity of channels 18*a-g* and ejectable from said one or more openings 20*a-g*. Preferably, the subsets of playing markers 34 are distinguishably identifiable by each set having a different color. The number of different colored sets corresponds to the number of allowed players.

FIG. 5A through FIG. 5F shows a subset of six playing markers with indicia 36 that are loosely receivable by said multiplicity of channels 18*a-g* and ejectable from said one or more openings 20*a-g* wherein each playing marker with indicia 36 defines game play. The playing markers with indicia 36 have the same dimensions as those without indicia. The indicia may define game play by allowing a player to eject one or more playing markers or to take an extra turn. How each indicia defines game play is described later.

Figure 6A:
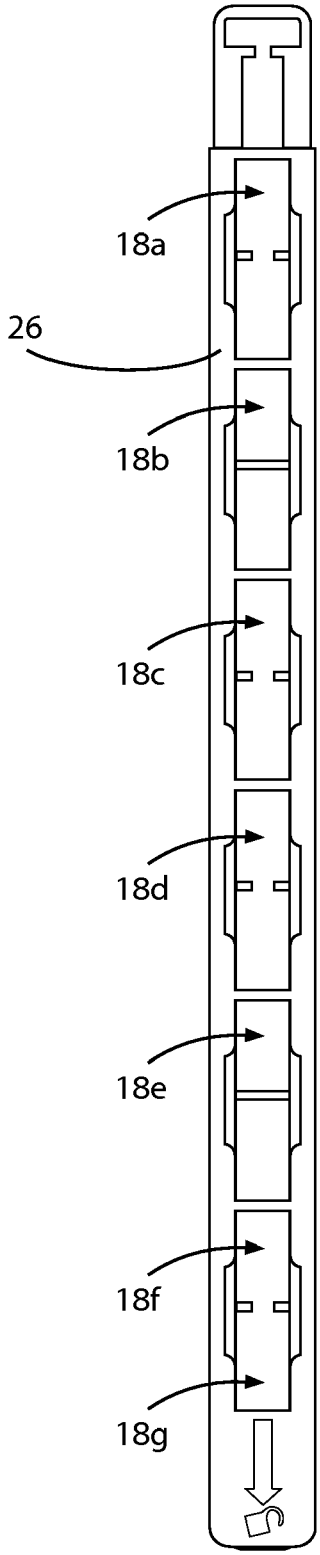
FIG. 6A shows the slideably mounted bracket in the closed position.
Figure 6B:
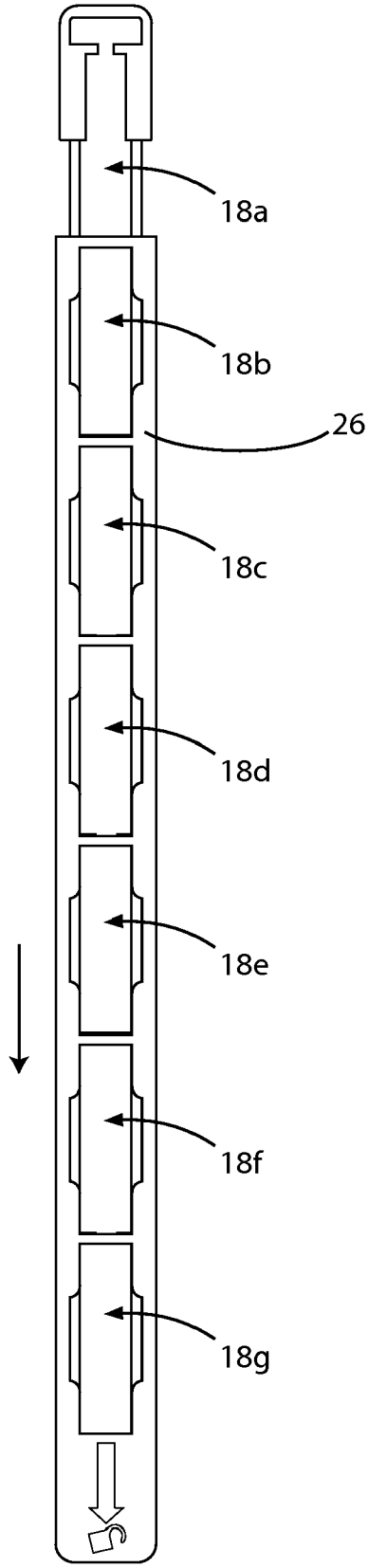
FIG. 6B shows the slideably mounted bracket in the open position.

FIG. 6A and FIG. 6B show overhead views of the preferred embodiment of the game apparatus. Both figures show the slideably mounted bracket 26, which is also shown in FIG. 1. The slidably mounted bracket 26 is mounted to said first wall 10 and said second wall 14. FIG. 6A shows the slidably mounted bracket 26 in the closed position. In the closed position, the slidably mounted bracket 26 prevents a player from inserting or removing playing markers from the multiplicity of channels 18*a-g*. The closed position facilitates transportation and storage. FIG. 6B shows the slidably mounted bracket 26 in the open position. In the open position, the slidably mounted bracket 26 allows a player to insert playing markers into the multiplicity of channels 18*a-g*. The open position facilitates game play.

Figure 7:
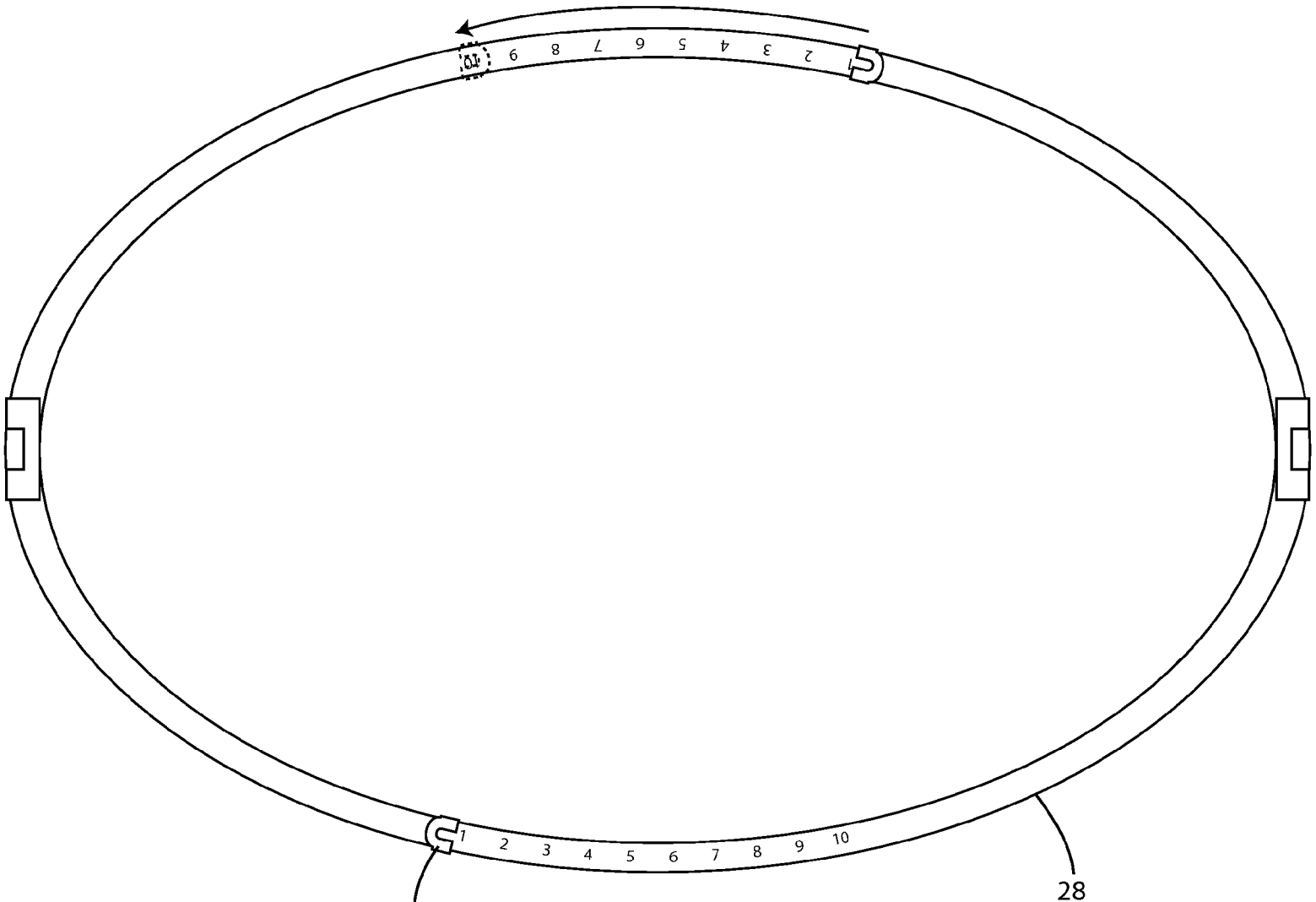
FIG. 7 shows a perspective view of the stand with the counter.

FIG. 7 shows a perspective view of an attachment 28 with a counter 32. The attachment 28 may be used to vertically suspend the matrix with respect to a horizontal supporting surface as shown in FIG. 1. Also as shown in FIG. 1, the attachment 28 may form a compartment to catch playing markers when the matrix is emptied. The counter 32 is used to keep score during game play.

Figure 8A:
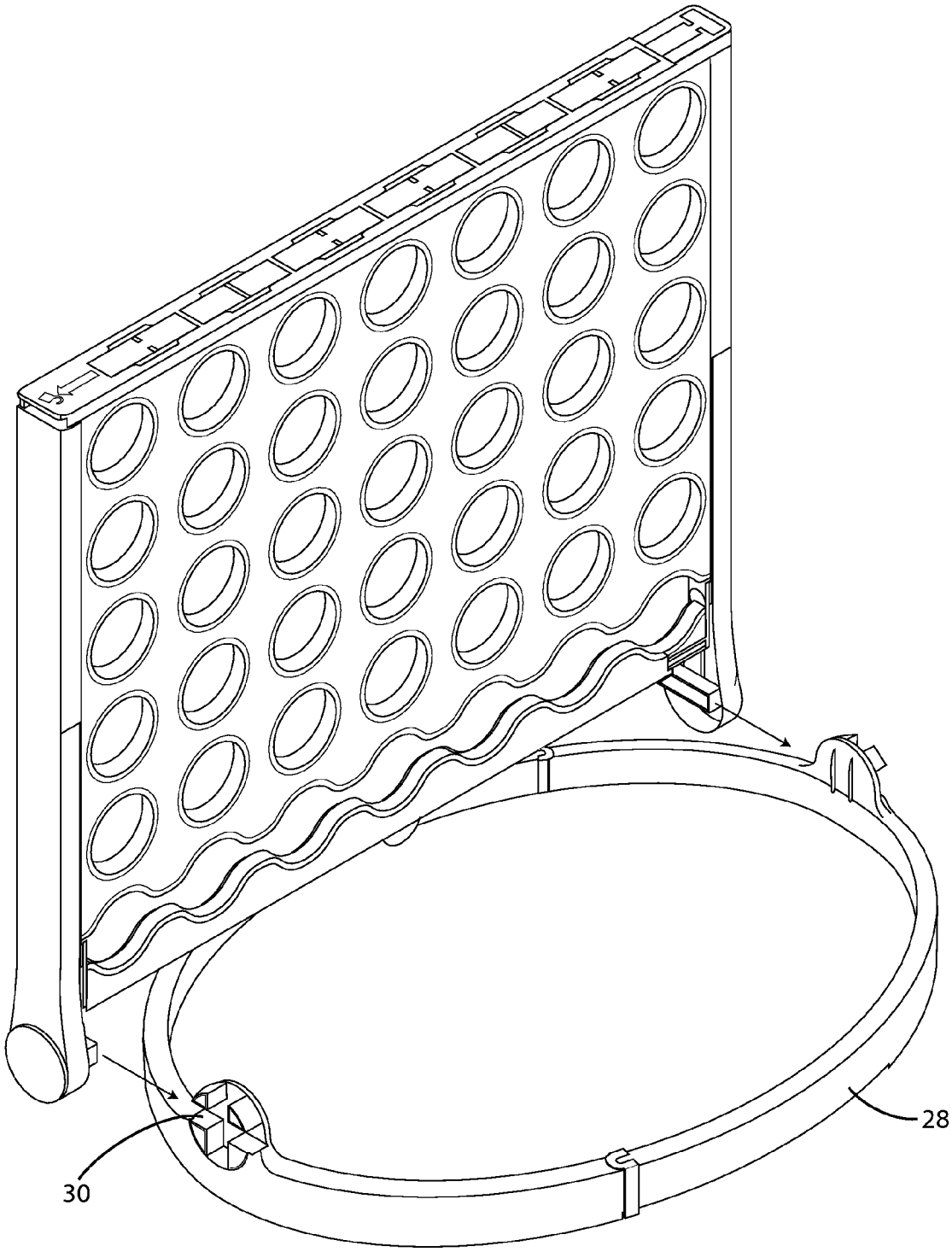
FIG. 8A-C show the supporting stand removed and used as a carrying handle.
Figure 8B:
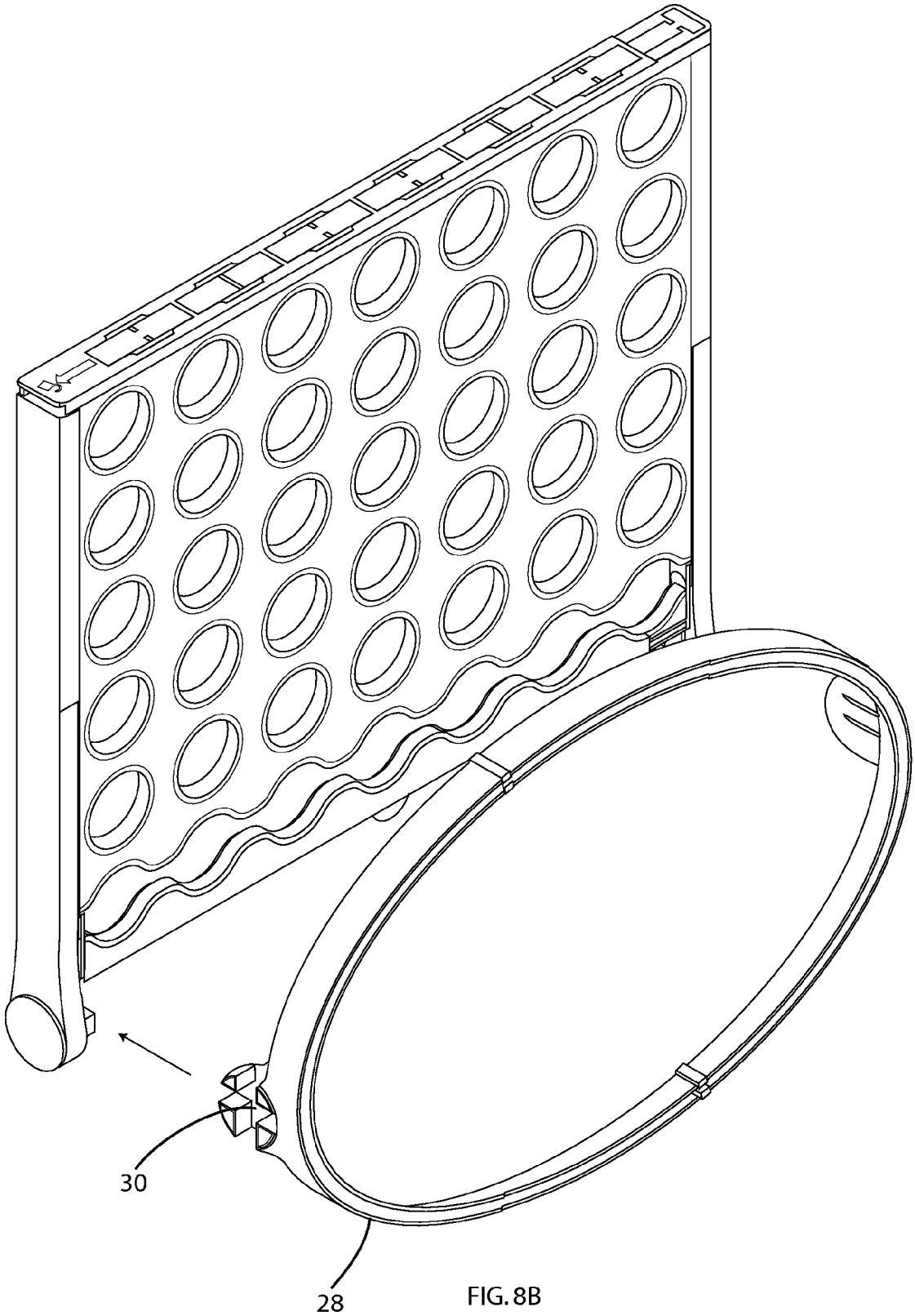
Figure 8C:
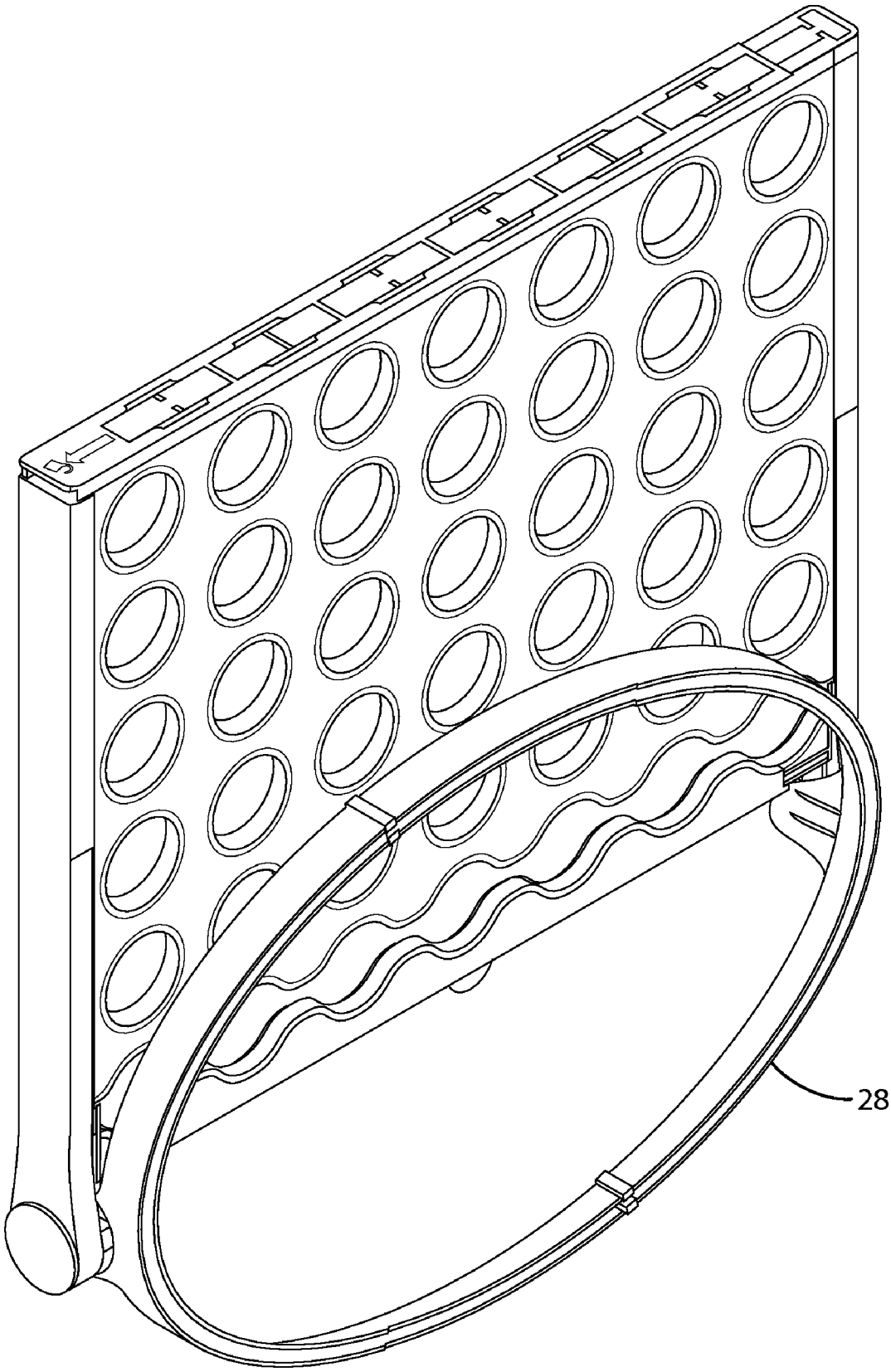

As shown in FIG. 8A, FIG. 8B, and FIG. 8C, the attachment 28 attaches to the game apparatus with a symmetric junction 30. These three figures show the attachment 28 being removed from the game apparatus, turned ninety degrees, and reattached to the game apparatus to operate as a carrying handle.

The remainder of this description details three examples of the game play of the preferred embodiment for two players ages six and older. Game play using the playing markers with indicia 36 is also described.

The first described game starts with an empty matrix and the first bar 22 and the second bar 24 pivoted downward to prevent playing markers from falling completely through the matrix. The second bar 24 is placed in the second position to prevent the playing markers from being ejected. This setup is as shown in FIG. 2B. Each player starts with a distinguishable set of twenty-one playing markers. For example, one player starts with twenty-one yellow playing markers and the other player starts with twenty-one red playing markers. The players decide who goes first and then the players alternately drop playing markers into one of the multiplicity of channels 18*a-g*. Play continues until one player wins by building a pattern of four like-colored playing markers in a row, either horizontally, vertically, or diagonally. The matrix may then be emptied of the playing markers by moving the second bar 24 to the first position as shown in FIG. 2A and pivoting the first bar 22 and the second bar 24 upward as shown in FIG. 3.

For all the described games, each time a player wins, that player may move the counter 32 to keep track of how many games each player has won.

The second described game starts with an empty matrix and the first bar 22 and the second bar 24 pivoted downward to prevent playing markers from falling completely through the matrix. The second bar 24 is placed in the first position to allow the playing markers to be ejected. This setup is as shown in FIG. 2A. Game play in this game is as in the first described game except that during a player's turn that player may either drop a playing marker into one of the multiplicity of channels 18*a-g* or eject a playing marker from the one or more openings 20*a-g*. When ejecting a playing marker, a player may only eject that player's own playing marker and not an opponent's playing marker. An ejected playing marker is removed from play and placed in the compartment formed when the attachment 28 is used to vertically suspend the matrix.

In the second described game, players may use the playing markers with indicia 36 that are shown in FIG. 5A through FIG. 5F. As an example, in the present described embodiment three of the twenty-one playing markers that a player has may be playing markers with indicia 36. Those three playing markers with indicia 36 may be three of the six types shown in FIG. 5A through FIG. 5F. The indicia on the face of each playing marker with indicia 36 determine how game play is affected.

Figure 5A:
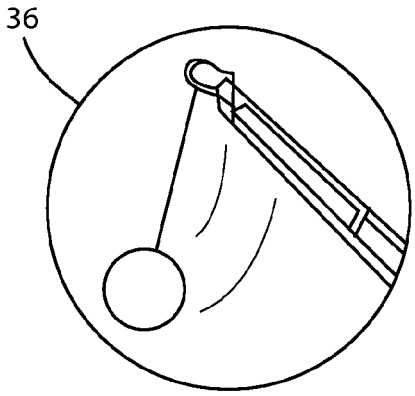
FIG. 5A-F shows six playing markers with indicia.

FIG. 5A is called "Wrecking Ball". When this playing marker is placed into one of the multiplicity of channels 18*a-g*, the player should immediately eject one of the opponent's playing markers. As previously described, the ejected playing marker is removed from play and placed in the compartment formed when the attachment 28 is used to vertically suspend the matrix.

Figure 5D:
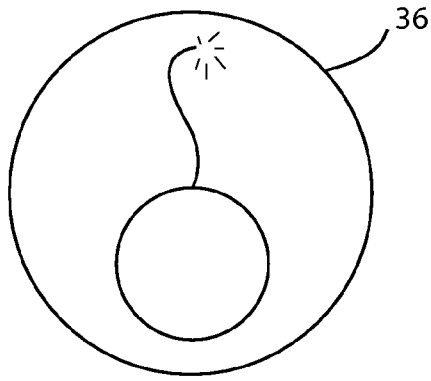
Figure 5B:
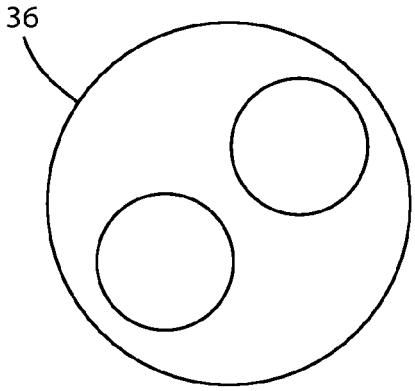

FIG. 5B is called "Play 2". When this playing marker is placed into one of the multiplicity of channels 18*a-g*, the player should immediately place another playing marker into the matrix.

Figure 5E:
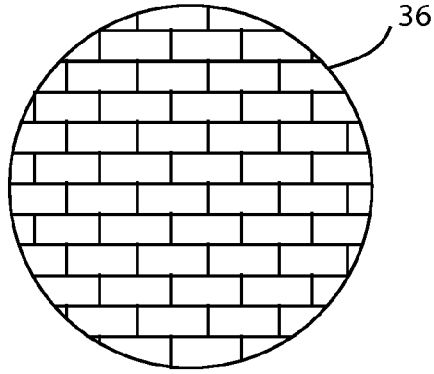
Figure 5C:
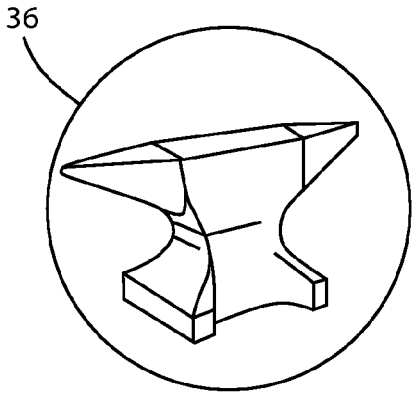

FIG. 5C is called "Anvil". When this playing marker is placed into one of the multiplicity of channels 18*a-g*, the player should eject all of the playing markers in that column except the "Anvil". Again, all the ejected playing markers are removed from the game and placed in the compartment formed when the attachment 28 is used to vertically suspend the matrix.

FIG. 5D is called "Column Bomb". When this playing marker is placed into one of the multiplicity of channels 18*a-g*, the player should eject all the playing markers in that column, including the "Column Bomb".

FIG. 5E is called "The Wall". When this playing marker is placed into one of the multiplicity of channels 18*a-g*, the player should immediately place another two playing marker into the multiplicity of channels 18*a-g*, however, the player may not use the second or third playing markers to create a winning pattern unless no other possibility exists.

Figure 5F:
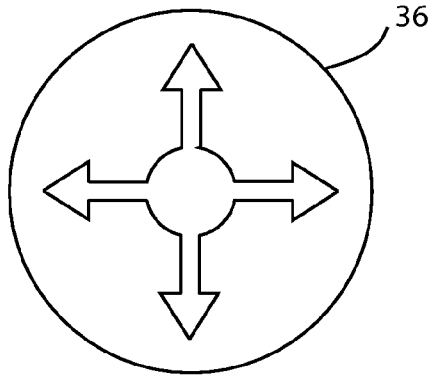

FIG. 5F is called "Dropout". When this playing marker is ejected, the player should immediately place a playing marker into one of the multiplicity of channels 18*a-g*.

The third described game starts with the matrix full of playing markers. If the matrix is empty, the players take turns dropping playing markers into the multiplicity of channels 18*a-g*, completing one row at a time. To begin, the second bar 24 is placed in the first position to allow the playing markers to be ejected. Then, the players alternatively take turns ejecting a playing marker from the matrix. If the playing marker that was ejected was part of a pattern of four like-colored playing markers in a row, either horizontally, vertically, or diagonally, the player that ejected the playing marker keeps that playing marker and takes another turn. If the playing marker that was ejected was not part of a pattern of four in a row, then that player places the ejected playing marker into one of the multiplicity of channels 18*a-g* and play passes to the other player. The playing marker may not be placed into the same column from which it was removed unless all the other columns are full. The first player to keep ten playing markers wins the game.

While the present invention has been illustrated by a description of various embodiments and while these embodiments have been set forth in considerable detail, it is intended that the scope of the invention be defined by the appended claims. It will be appreciated by those skilled in the art that modifications to the foregoing preferred embodiments may be made in various aspects. It is deemed that the spirit and scope of the invention encompass such variations to be preferred embodiments as would be apparent to one of ordinary skill in the art and familiar with the teachings of the present application.

What is claimed is:

1. A strategic pattern building board game comprising:

a first wall having a multiplicity of first apertures;

a second wall having a multiplicity of second apertures juxtaposed relative to said first wall;

a set of playing markers;

a multiplicity of channels disposed between said first wall and said second wall, said multiplicity of channels having a first end for loosely receiving the playing markers and a second end opposite the first end, said second end for ejecting and emptying the playing markers from said multiplicity of channels;

a retainer comprising a first bar and a second bar, said retainer mounted to said first wall and said second wall and spaced apart from said second end, said first bar being pivotably mounted in a maintaining position for maintaining the playing markers in said multiplicity of channels and pivotable to an emptying position for emptying the playing markers from said multiplicity of channels; and a plurality of openings for ejecting the playing markers, said plurality of openings defined between said second end and said retainer with said second bar in an ejectable position allowing playing markers to be ejected at said plurality of openings;

wherein said second bar is shiftable along said retainer to prevent the playing markers from being ejected at said plurality of openings.

2. The game recited in claim 1 wherein said first apertures are within the first wall to define a matrix of said first apertures within the first wall.

3. The game recited in claim 2 wherein said matrix is vertically suspended with respect to a horizontal supporting surface.

4. The game recited in claim 3 further comprising an attachment wherein said attachment attaches to said matrix in a first position as a stand for supporting said vertically suspended matrix and as a compartment for catching playing markers and in a second position as a carrying handle.

5. The game recited in claim 1 wherein a multiplicity of said playing markers defines a distinguishably identifiable subset of said playing markers.

6. The game recited in claim 5 wherein each distinguishably identifiable subset of said playing markers has an associated color assigned to a particular player.

7. The game recited in claim 5 wherein said subset of said playing markers comprises indicia, said indicia defining game play to shift said second bar of said retainer to the ejectable position and to eject at least one of said playing markers from at least one of said openings.

8. The game recited in claim 5 wherein said subset of said playing markers comprises indicia, said indicia defining game play for a further playing marker received by at least one of said multiplicity of channels from a single player.

9. The game recited in claim 1 further comprising a bracket that is slideably mounted to said first wall and said second wall.

10. The game recited in claim 9 wherein said bracket is slideable to an open position that allows a player to insert playing markers into the multiplicity of channels and that facilitates game play.

11. The game recited in claim 9 wherein said bracket is slideable to a closed position that prevents a player from inserting or removing playing markers from the multiplicity of channels and that facilitates transportation and storage.

12. The game recited in claim 1 further comprising a counter for scoring during game play.

* * * * *